US006669286B2

(12) United States Patent
Iusim

(10) Patent No.: US 6,669,286 B2
(45) Date of Patent: Dec. 30, 2003

(54) SYSTEM FOR IMPROVING BODY POSTURE

(75) Inventor: Moshe Iusim, Haifa (IL)

(73) Assignee: Logical Electronic Engineering (1991) Ltd. (IL)

( * ) Notice: Subject to any disclaimer, the term of this patent is extended or adjusted under 35 U.S.C. 154(b) by 0 days.

(21) Appl. No.: 10/125,296

(22) Filed: Apr. 16, 2002

(65) Prior Publication Data

US 2002/0171272 A1 Nov. 21, 2002

(30) Foreign Application Priority Data

Apr. 16, 2001 (IL) ..... 142611

(51) Int. Cl.[7] ..... G08B 23/00
(52) U.S. Cl. ..... 297/217.4; 340/573.7
(58) Field of Search ..... 297/217.4; 340/667, 340/573.7

(56) References Cited

U.S. PATENT DOCUMENTS 2,263,670 A * 11/1941 Arkin ..... 340/573.7 X
3,670,320 A * 6/1972 Palmer ..... 340/573.7
4,007,733 A * 2/1977 Celeste et al. ..... 340/573.7 X
4,191,949 A * 3/1980 Myers ..... 340/573.7
4,617,525 A * 10/1986 Lloyd ..... 340/573.1
4,730,625 A * 3/1988 Fraser et al. ..... 340/573.7 X
4,871,998 A * 10/1989 Chailou ..... 340/573.7
5,038,137 A * 8/1991 Lloyd ..... 340/573.7
5,158,089 A * 10/1992 Swezey et al. ..... 340/573.7 X
5,168,264 A * 12/1992 Agustin ..... 340/573.7
5,402,107 A * 3/1995 Rencavage ..... 340/573.7
5,469,861 A * 11/1995 Piscopo et al. ..... 340/573.7 X
5,749,838 A * 5/1998 Kline ..... 340/573.7 X
6,019,738 A * 2/2000 Brandon ..... 340/573.7 X
6,057,767 A * 5/2000 Barnoach ..... 340/573.7 X
6,146,312 A * 11/2000 Sclichter ..... 340/573.7 X
6,348,663 B1 * 2/2002 Schoos et al. ..... 340/667 X
2002/0175821 A1 * 11/2002 Ruppel ..... 340/575
2003/0001749 A1 * 1/2003 Ishida ..... 340/667

* cited by examiner

*Primary Examiner*—Rodney B. White
(74) *Attorney, Agent, or Firm*—Anthony J. Casella; Gerald E. Hespos

(57) ABSTRACT

A system is provided for inducing improvement in sitting posture. The system is associated with a seating device having a seat and a backrest. The system includes a first member associated with the seat or with the backrest and a second member associated with the backrest. At least one sensor is located in the first member for detecting the presence of a user and for providing an indication of the presence of the user. At least one sensor is located in the second member for detecting the position of the user's back and for providing an indication of the position of the user's back. An alarm is connected to the sensors for informing the user whether the sitting posture is correct or incorrect, based on the indications of the sensors.

20 Claims, 7 Drawing Sheets

SYSTEM FOR IMPROVING BODY POSTURE

FIELD OF THE INVENTION

The presents invention relates to the field of improving body posture, particularly posture in a sitting position. More specifically, the present invention concerns a system for inducing improvements in sitting posture, having feedback for aiding a user to improve sitting habits.

BACKGROUND OF THE INVENTION

A straight, upright posture is always associated with good health and with the image of a dynamic person. Conversely, a bent posture is associated with poor health. Poor posture is an indication of poor muscle tone. Exhortations to "stand straight" or "pull your shoulders back" do not improve body posture. Only augmentation of muscle tone leads to an improvement in posture.

Several problems may result from incorrect body posture. For example, upper back pain is very often associated with round back noss (kyphosis); thoracic kyphosis can produce a diminution of chest volume.

Good posture should be maintained with a minimum of muscular effort. In other words, the body should be symmetrical; the centers of gravity of the various portions of the trunk should be situated as near as possible to a vertical line passing through the lumbar-sacral joint.

Among children, adolescents or young adults, physical therapy, exercise or swimming helps to increase the muscular tone of the upper back, thus improving their posture. Athletes or dancers achieve their good posture through constant practice, high motivation and activity enjoyment. During childhood, activity; enjoyment is probably the most important factor. To be effective for children, any exercise must be in the form of a game that they enjoy, or a disruption that disturbs their enjoyment of an activity if they assume the wrong posture.

In modern society, people spend an increasing amount of their time in sitting activities, such as watching television, operating computers either at work or for leisure, driving, eating or reading.

Awareness of incorrect body posture while sitting is the first step in correcting bad posture. The most important step in development of muscle tone for achieving good posture is muscular re-education of the upper back. The use of feedback for developing correct muscle tone is mandatory, and can be implemented while a person is sitting, for example, while using a computer.

Learning how to ride a bicycle requires attention and concentration; once it has been learnt, the action is done unconsciously and is not forgotten. In the same way, if postural reflexes are induced by an alert feedback, the learned movement will become unconsciously integrated.

In addition, varicose veins are a common disorder, mostly among women, especially among those who spend more time in sedentary occupations. During a prolonged time of sitting with the knees flexed, venous congestion increases the risk of thrombus formation and, of course, the risk of pulmonary embolism. The best treatment for these disorders is prevention with anti-coagulants in severe risk patients, and prevention with exercise in the normal population.

DISCLOSURE OF THE INVENTION

It is therefore an object of the present invention to provide an alarm system having feedback that induces a conditioned reflex in the user to improve sitting posture.

It is an additional object of the present invention to help prevent deep thrombosis and pulmonary embolism by alerting and educating a user to stand up and move at least once every half hour or so during a period of continuous sitting.

The invention therefore provides a system for inducing improvement in sitting posture associated with a seating device having a seat and a backrest, said system having a first member associated with said seat or with said backrest and a second member associated with said backrest, said system further comprising at least one sensor located in the first member for detecting the presence of a user and for providing an indication of same; at least one sensor located in the second member for detecting the position of the user's back and for providing an indication of same, and an alarm connected to the sensors for informing the user whether the sitting posture is correct or incorrect, based on the indications of the sensors.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the drawings.

DETAILED DESCRIPTION

Figure 1:
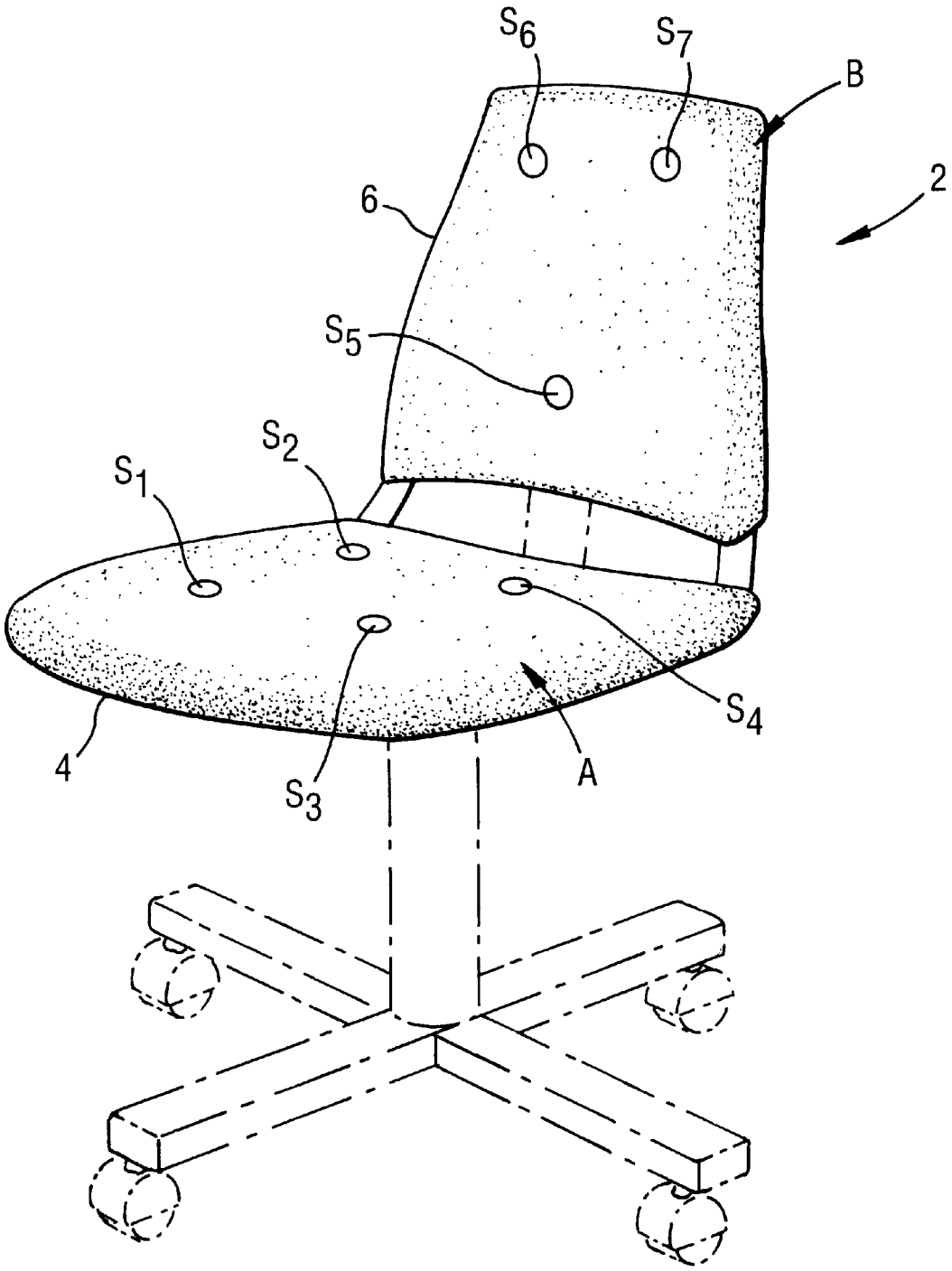
FIG. 1 illustrates an embodiment of a system for inducing correct posture habits, applied to a chair.
Figure 2:
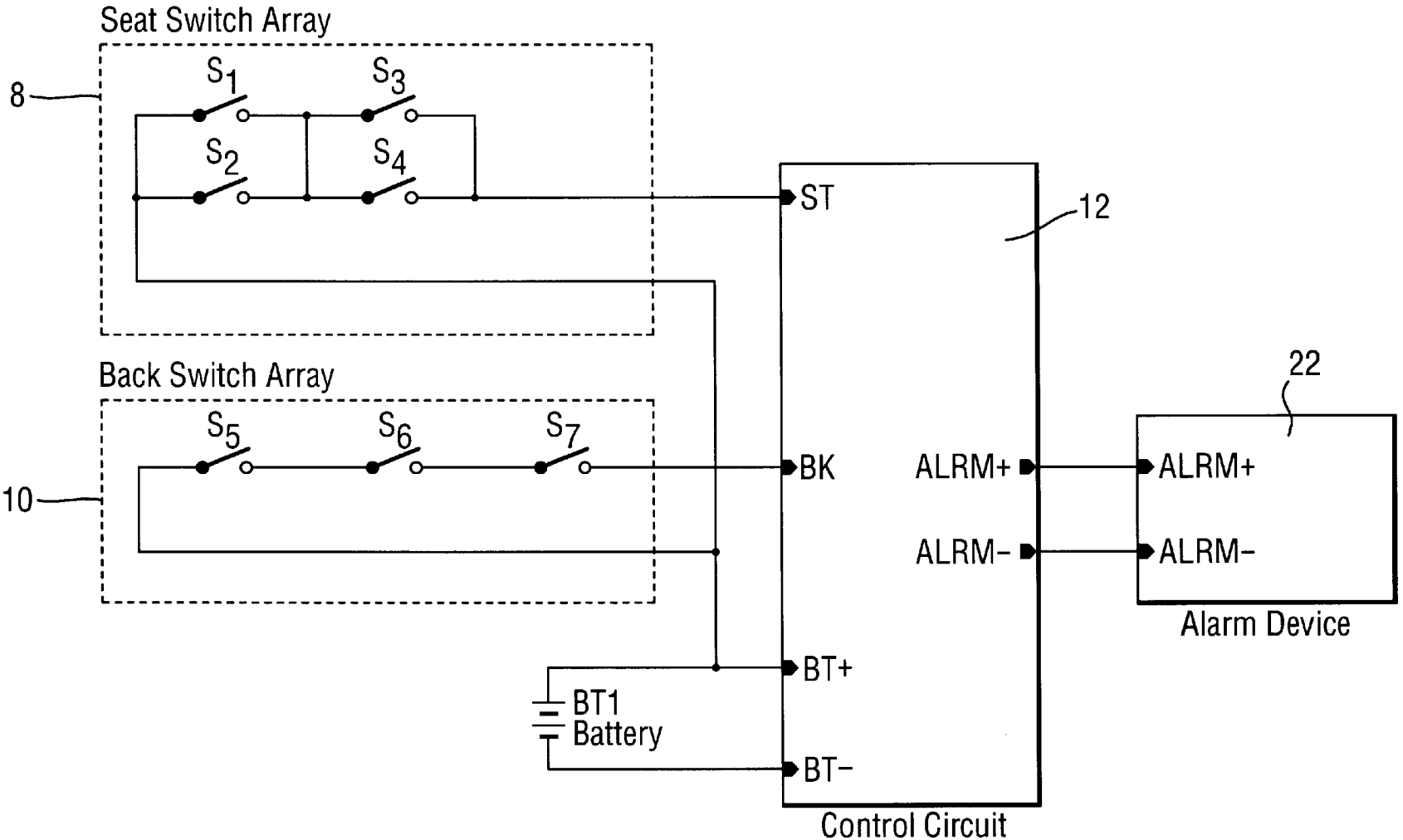
FIG. 2 is a block diagram of the system according to the invention.

FIG. 1 shows, as an illustrative example, an embodiment of a system 2 for inducing correct posture, utilized in a sitting device, for example, a chair, illustrated by hatched lines. The system has a first member A associated with the seat 4 of the sitting device and a second member B associated with the backrest 6 of the sitting device. Four switches S1 to S4 are embedded in member A and three switches S5 to S7 are embedded in member B. As can be seen in FIG. 2, the switches S1, S2 and S3, S4 are connected in parallel, and the two pairs are interconnected in series. It should be noted that instead of the illustrated contact switches acting as sensors for detecting the presence of a user and/or portions of the user's body, proximity detectors, or a mixture of contact and proximity detectors, may be provided. The plurality of switches is used to detect the presence of a person sitting in the chair. In order to do so, it is sufficient for only two of the switches to be pressed (closed), one of each pair. This approach avoids false alarms if small objects are left on the chair, and reliably detects a person sitting in the chair, in almost any posture. It should be noted that the first member A can just as well be associated with the backrest 6.

The three switches S5 to S7, located in member B, are connected in series. Their purpose is to detect a correct, straight leaning of the user's back along member B. The three switches will be activated simultaneously only if the user is sitting correctly. The output signals of the switches acting as sensors, may be in the form of analog or digital signals.

The block diagram of FIG. 2 thus illustrates two switch arrays 8 and 10, battery BT1, control circuit 12 and alarm 22, constituted by a buzzer in the illustrated embodiment. Instead of a sound-producing alarm, the system may just as well utilize an optical, vibrating alarm, or a combination of both. When a user is seated on member A, a signal ST will be fed Trough at least two of switches S1 to S4, to the positive lug of battery BT+ or to logic state 1. When the user is correctly seated, a signal BK will also be fed through switches S5 to S7, to the positive lug of battery BT+ or to logic state 1.

Figure 3:
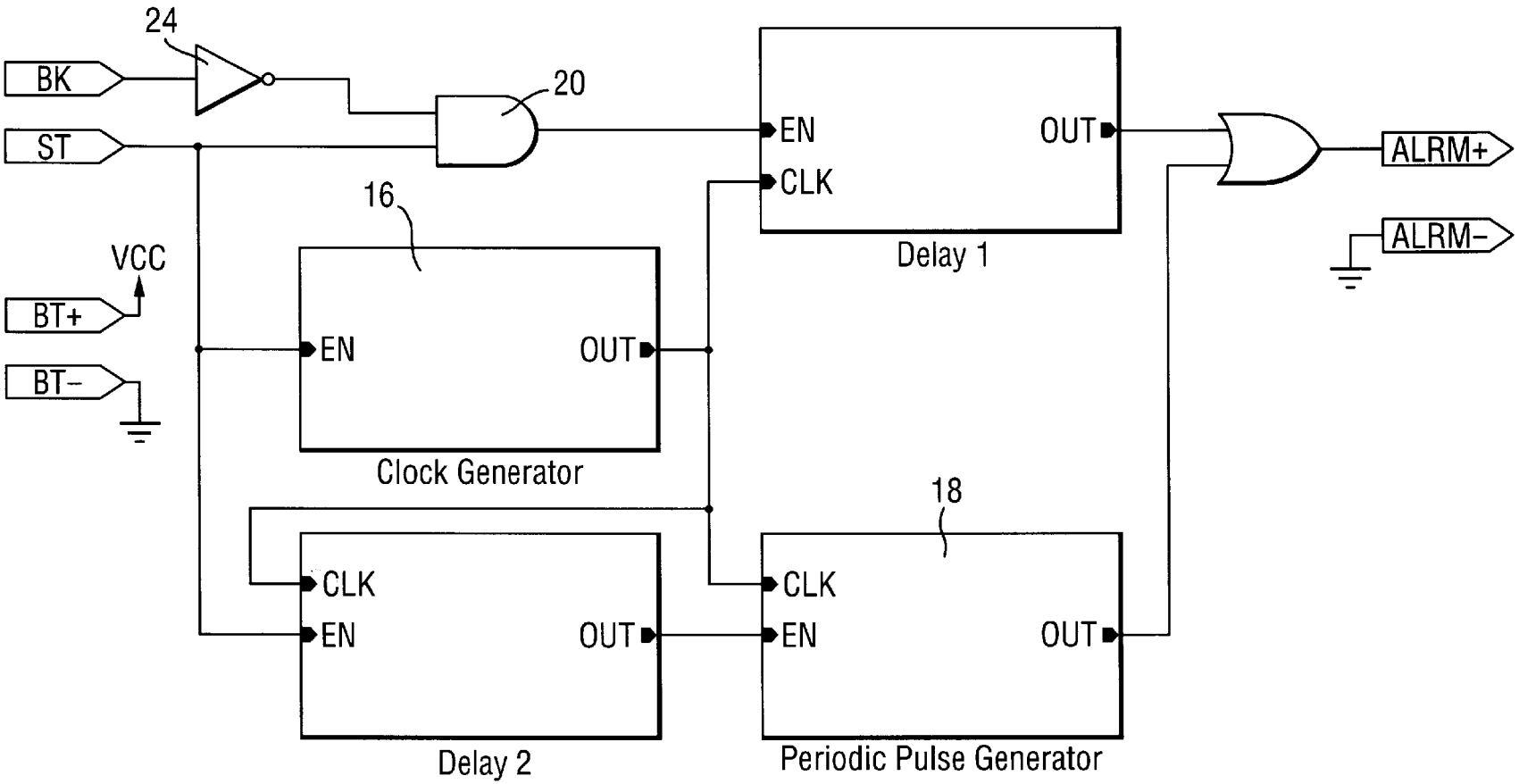
FIG. 3 is a block diagram of the control circuit of FIG. 2.

FIG. 3 shows a block diagram of control circuit 12. When a user sits on member A, signal ST is set to logic 1, enabling the clock generator 16, which has an output clock signal period of approximately 0.9 seconds. The clock signal is utilized by DELAY1, DELAY2 and periodic pulse generator 18.

Due to the OR gates either DELAY1 or periodic pulse generator 18 can activate the alarm 22, by raising the voltage of signal ALRM+.

If the user is improperly seated, signal ST will be at logic 1, but signal BK will remain at logic 0. Due to inverter gate 24, this will result in a logic 1 level at the AND gate output 20, enabling the action of DELAY1.

DELAY1 activates its output (logic 1) approximately 30 seconds after the raising of its enable signal EN to logic 1. DELAY1 deactivates its output (logic 0) immediately following the return to logic 0 of its EN signal. As a result, when a person sits on member A, the alarm will be activated approximately after 30 seconds of continuous improper posture. The alarm remains active until a good sitting posture is assumed. The purpose of the alarm is to give an audible or other feedback signal to the user, indicating an incorrect sitting posture. If the user's posture is corrected before 30 seconds elapse, the alarm will not be activated. This allows reasonable freedom to the user in continuing activities, without being unnecessarily disturbed.

When the user is seated on member A, signal ST switches into logic 1, activating DELAY2, regardless of the user's posture. After approximately one-half hour of continuous sitting, DELAY2 raises its output signal to logic 1, enabling the periodic pulse generator 18 and limiting its output to a pulse having a duration of 0.9 seconds, approximately every 15 seconds. The resulting short alarms alert the user that it is time to stand up and move for a while. The short, periodic alarm signals will operate until the user stands up, thereby returning ST to logic 0.

Figure 4:
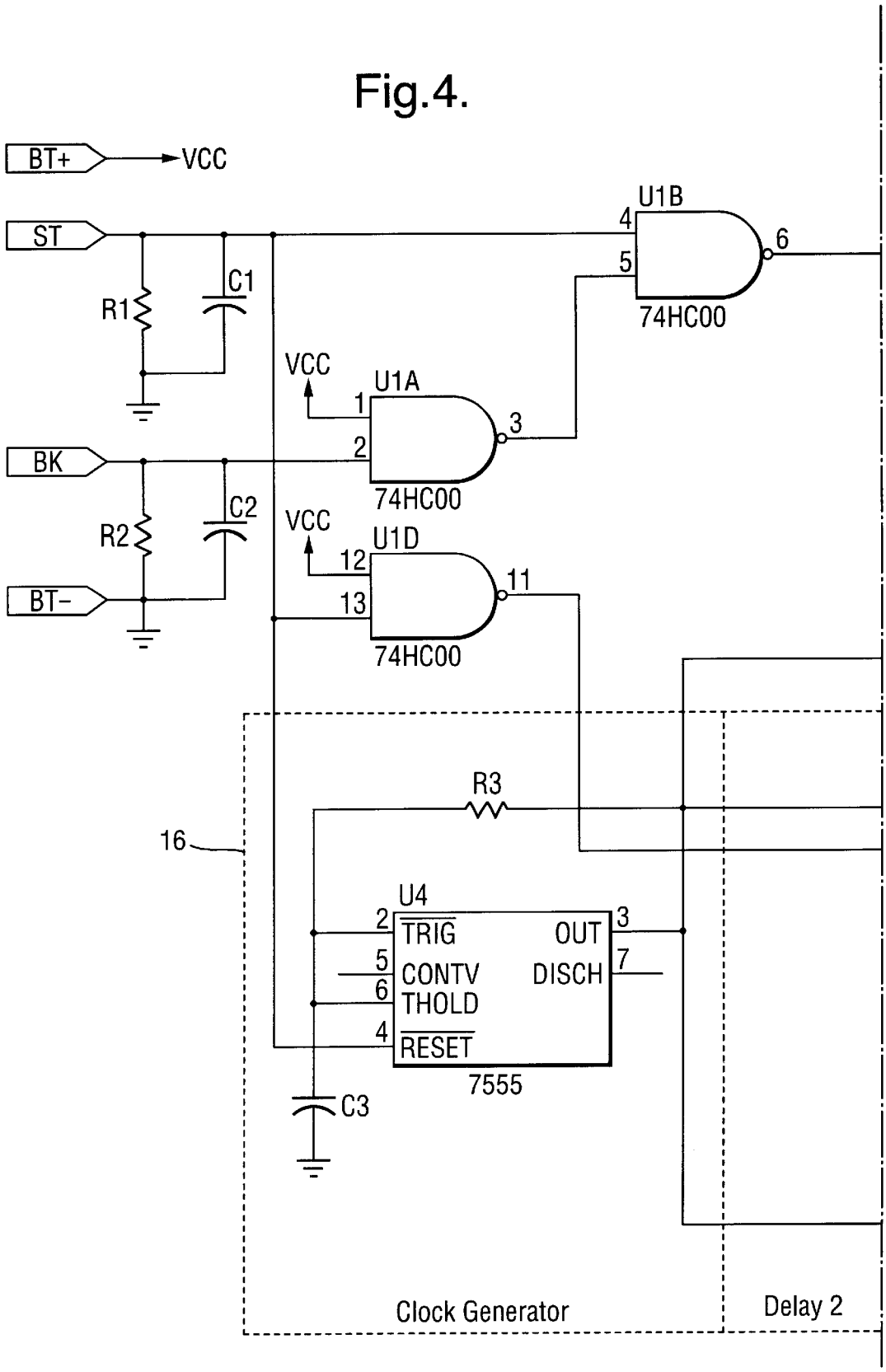
FIG. 4 illustrates a detailed electronic control circuit in greater detail, showing the diverse blocks illustrated in FIG. 3.
Figure 4:
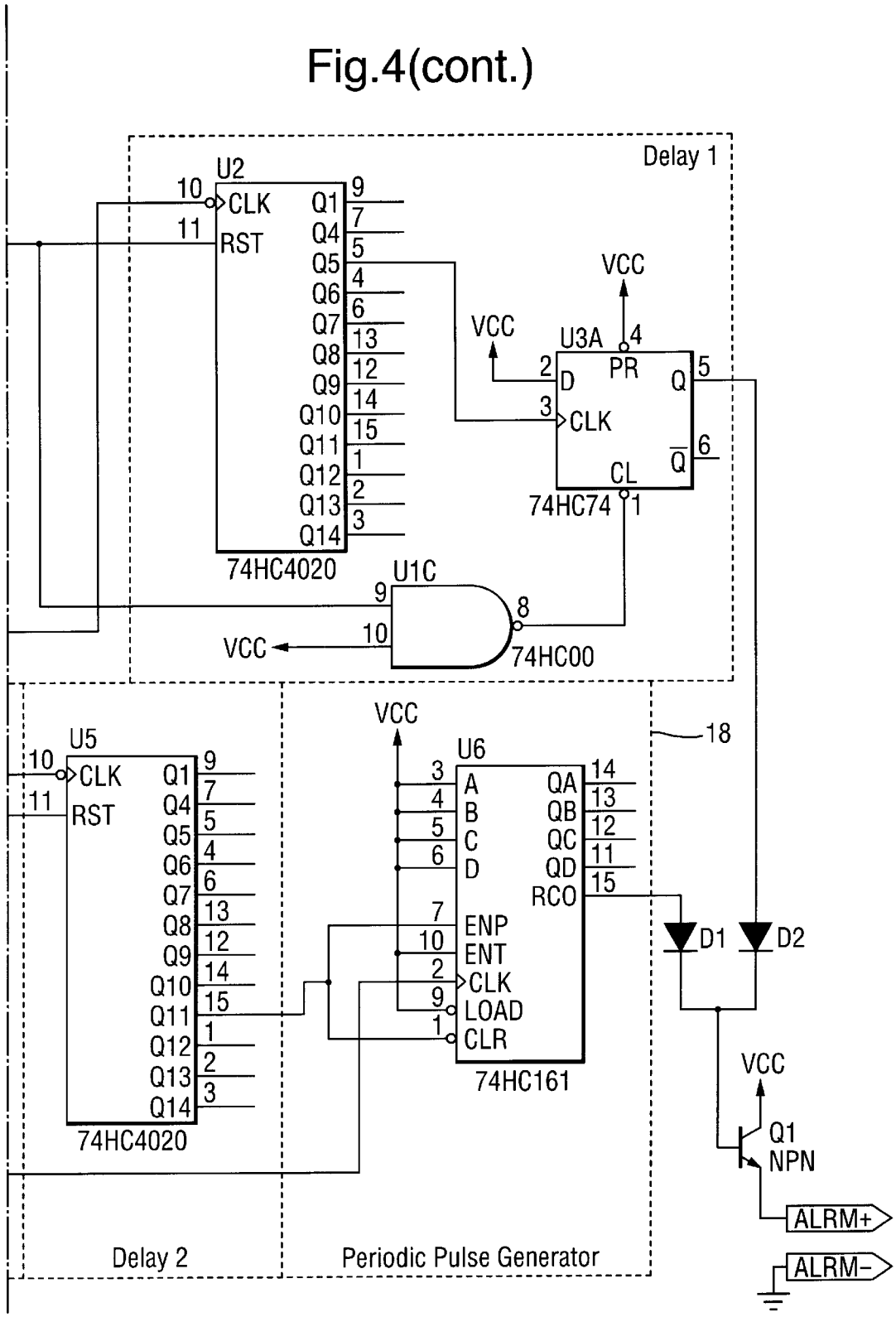

FIG. 4 illustrates a detailed electronic circuit diagram. Resistors R1 and R2 are pull-down resistors. Their role is to ensure a logic 0 level of signals ST and BK, while the switches are not activated. Capacitors C1 and C2 are debouncing capacitors, for filtering the signals of the switches.

Clock generator 16 comprises units U4, R3 and C3. It is constituted by an oscillator based on a 555 chip, with R3 and C3 values designed to provide a 0.9 second oscillation period. When the user sits on member A (either correctly or not), the signal ST transition to logic 1 enables the operation of the clock generator.

Figure 5:
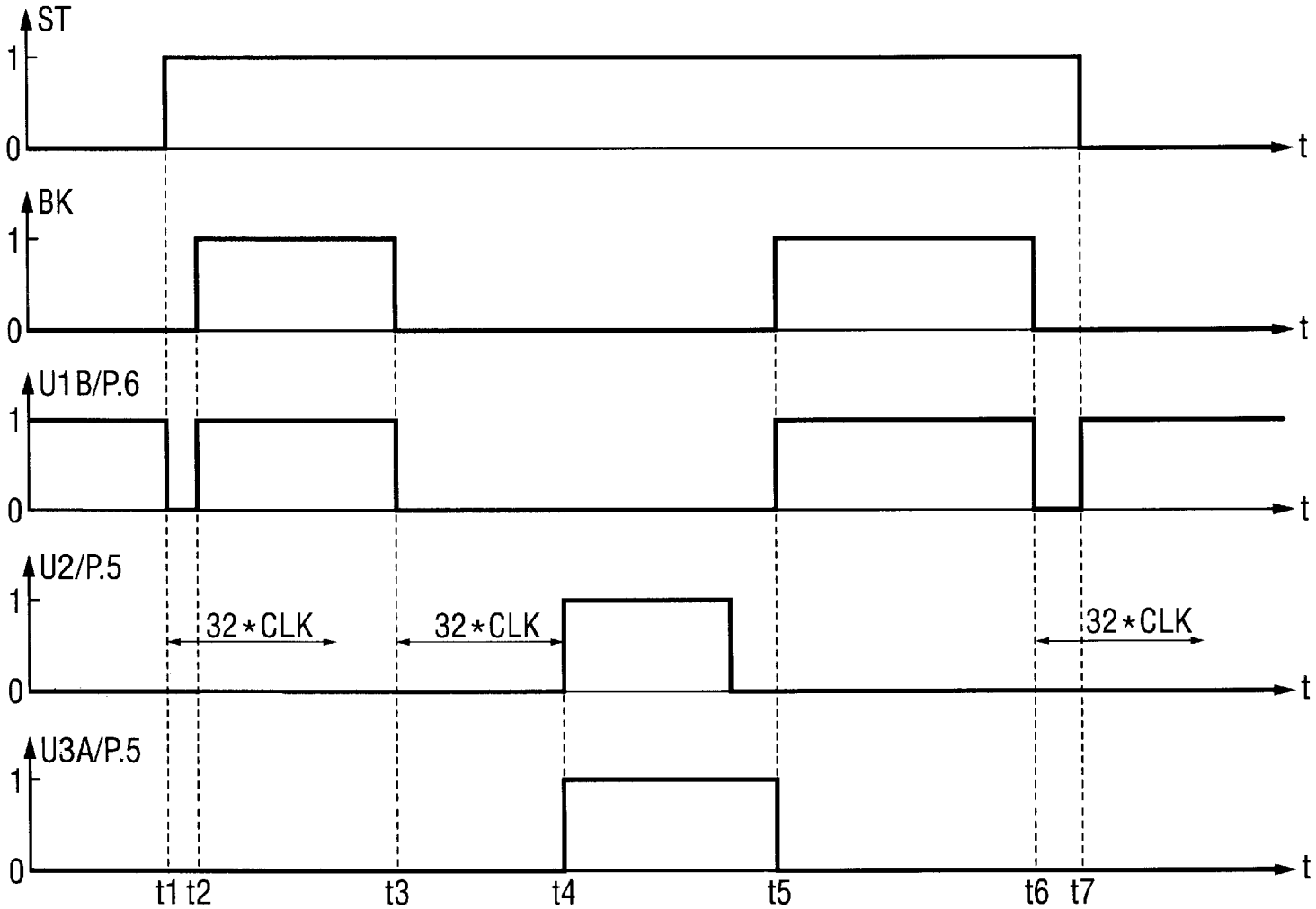
FIG. 5 shows characteristic waveforms for delay 1 block of FIG. 4.

The DELAY1 block comprises unit U2, which is a binary counter and flip-flop U3A. When the user sits incorrectly at time T1 (FIG. 5), signal ST transitions to logic 1 and signal UK remains at logic 0. In this case, U1B/pin 6 transitions to logic 0, initiating the counting of 32 clock pulses by U2. If the user sits correctly at time T2, BK transitions to logic 1 and the counter is disabled and reset, with U2/pin 5 remaining at logic 0. When the user sits incorrectly at time T3, counter U2 counts 32 clock pulses. After 32 clock pulses have been counted, U2/pin 5 transitions to logic 1, causing the flip-flop U3A output U3A/pin 5) to transition to logic 1, activating transistor Q1 through diode D2 and activating the alarm. When the user sits correctly at time T5, signal BK transitions to logic 1, forcing a logic 1 at U1B/pin 6, which clears flip-flop U3A, resets and disables counter U2, and interrupts the alarm.

Figure 6:
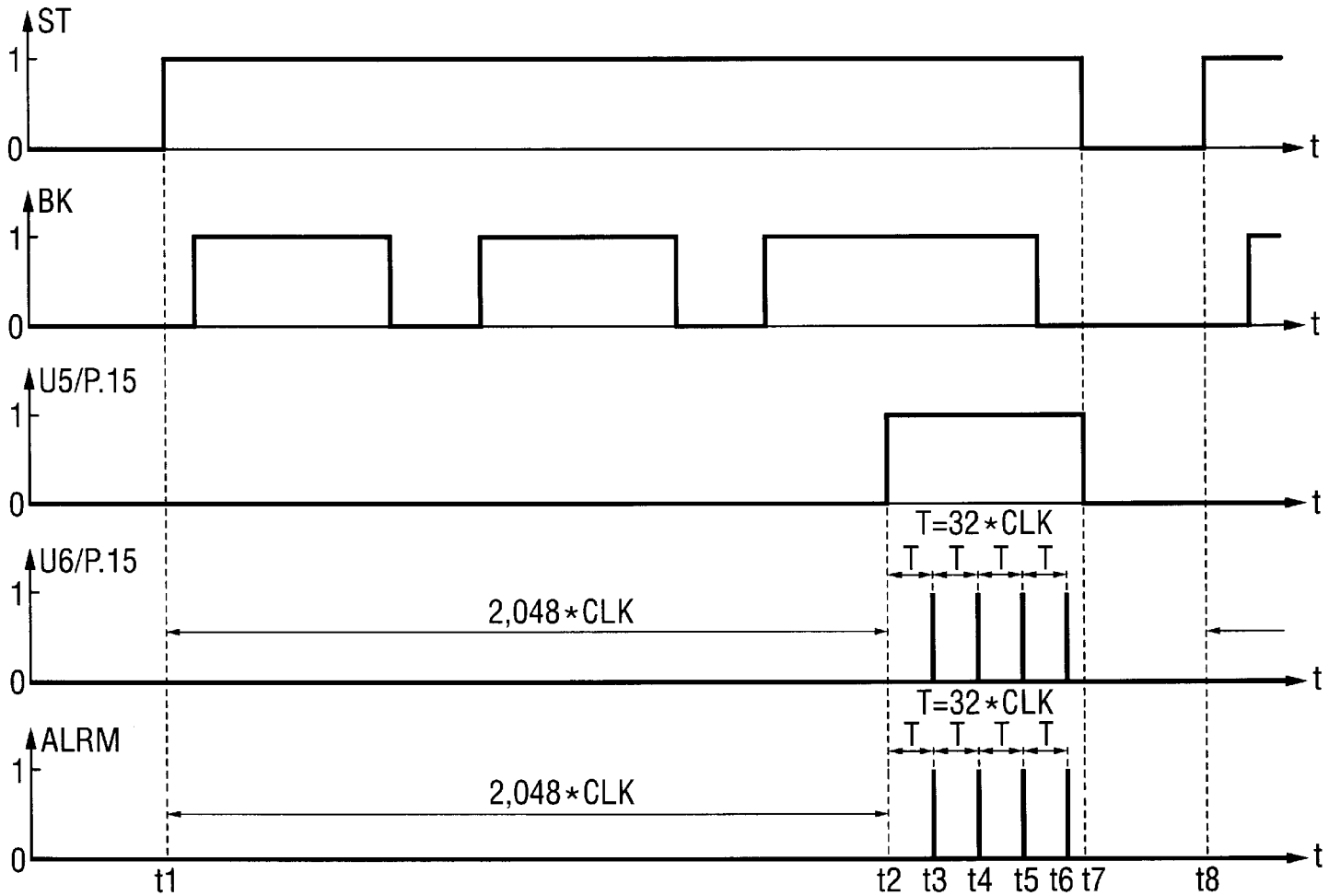
FIG. 6 shows characteristic waveforms for delay 2 block of FIG. 4.

The DELAY2 block comprises a counter U5. When the user sits at time T1, either correctly or incorrectly, signal ST transitions to logic 1 (FIG. 6), enabling the counting operation of U5. After counting 2,048 clock pulses (approximately half an hour) at time T2, U5/pin 15 transitions to logic 1, enabling the operation of the periodic pulse generator 18.

Periodic pulse generator 18 includes a unit U6, which is a four-bits counter, while U5/pin 15 is at logic 0 (T1 to T2), the counter is in LOAD mode and all of its outputs are forced to logic 0. U6/pin 15 (ripple carry out) will transition to logic 1 for one clock (0.9 second) every sixteen clock pulses (in the example depicted in FIG. 6, at times T3, T4, T5 and T6). U6/pin 15 output pulses activate transistor Q1 through diode D1, activating the alarm for brief periods of about one second, every 15 seconds, as a reminder for the user to stand up and move When the user stands up at time T7, signal ST returns to logic 0, resetting and disabling counter U5 and clearing counter U6, which stops the alarm pulses.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative -and not restrictive, the scope of the invention being indicated by the appended claims rather than by the foregoing description, and all changes which come within the meaning and range of equivalency of the claims are therefore intended to be embraced therein.

What is claimed is:

1. A system for inducing improvement in sitting posture associated with a seating device having a seat and a backrest, said system having a first member associated with said seat or with said backrest and a second member associated with said backrest, said system further comprising:

at least one sensor located in said first member for detecting the presence of a user and for providing an indication of same;

at least one sensor located in said second member for detecting the position of the user's back and for providing an indication of same, and an alarm connected to said sensors for informing the user whether the sitting posture is correct or incorrect, based on the indications of said sensors.

2. The system as claimed in claim 1, further comprising an electronic circuit having at least one timer or delay circuit for delaying the operation of said alarm.

3. The system as claimed in claim 2, wherein said electronic circuit activates said alarm following a predetermined period of uninterrupted sitting time.

4. The system as claimed in claim 1, wherein the output of said sensors is an analog signal.

5. The system as claimed in claim 1, wherein the output of said sensors is a digital or logic signal.

6. The system as claimed in claim 1, wherein said sensor is a switch.

7. The system as claimed in claim 1, wherein at least one sensor is located in said second member in a position substantially aligned with the user's lower back, and at least one sensor is located in said second member in a position substantially aligned with the user's upper back, when the user is sitting.

8. The system as claimed in claim 1, comprising one or more groups of sensors located in said second member and positioned behind the user's back, wherein each of said groups includes at least one sensor.

9. The system as claimed in claim 1, wherein said at least one sensor is a contact sensor.

10. The system as claimed in claim 1, wherein said at least one sensor is a proximity sensor.

11. The system as claimed in claim 1, further comprising an electronic circuit for measuring and recording the length of time that the user sits on said first member.

12. The system as claimed in claim 1, wherein said alarm produces an audible alarm.

13. The system as claimed in claim 1, wherein said alarm produces an optical alarm.

14. The system as claimed in claim 1, wherein said alarm produces a vibrating alarm.

15. A system for inducing improvement in seating posture, comprising;

a seating device having a seat and a backrest;

at least one sensor for detecting a user seated on said seating device and for providing an indication of the user seated on said setting device;

at least one backrest sensor in said backrest for detecting a position of a user's back on the backrest and for providing an indication of the position of the user's back on the backrest; and an alarm connected to the at least one backrest sensor for informing the user whether the seating posture is correct or incorrect based on the indications of said at least one backrest sensor.

16. The system of claim 15 wherein the at least one backrest sensor includes a lower backrest sensor located in said backrest in a position substantially aligned with a lower back region of the user seated in the seating device and at least one upper backrest sensor located in said backrest in a position substantially aligned with an upper back region of the user when the user is seated in the seating device.

17. The system of claim 16 further comprising an electronic circuit having at least one delay means for delaying the operation of said alarm.

18. The system of claim 17 wherein said electronic circuit activates said alarm following a predetermined period of uninterrupted seating time.

19. The system of claim 15, wherein the at least one sensor for detecting a user seated on the seating device comprises at least one seat sensor in said seat.

20. The system of claim 19, wherein the at least one seat sensor comprises a plurality of seat sensors.

* * * * *